United States Patent [19]

Tsuzuki

[11] Patent Number: 4,696,477

[45] Date of Patent: Sep. 29, 1987

[54] GAME APPARATUS

[75] Inventor: Akio Tsuzuki, Tokyo, Japan

[73] Assignee: Tomy Kogyo Co., Inc., Japan

[21] Appl. No.: 824,104

[22] Filed: Jan. 30, 1986

[51] Int. Cl.[4] ..... A63F 3/00

[52] U.S. Cl. ..... 273/241; 273/249; 273/287; 273/290

[58] Field of Search ..... 273/241, 242, 249, 287, 273/290, 288, 86 E, 1 GF; 446/3

[56] References Cited

U.S. PATENT DOCUMENTS

| | | | |
|---|---|---|---|
| 974,376 | 11/1910 | Goodwin | 273/86 E |
| 3,201,129 | 8/1965 | McFarland et al. | 273/249 |
| 4,147,358 | 4/1979 | Erickson | 273/241 |
| 4,324,065 | 4/1982 | Cooper | 273/1 GF |
| 4,343,475 | 8/1982 | Stader | 273/276 |
| 4,394,017 | 7/1983 | Maloy | 273/287 |

FOREIGN PATENT DOCUMENTS

| | | | |
|---|---|---|---|
| 438097 | 11/1935 | United Kingdom | 273/86 E |

*Primary Examiner*—Richard C. Pinkham
*Assistant Examiner*—Benjamin Layno
*Attorney, Agent, or Firm*—Staas & Halsey

[57] ABSTRACT

An amusement device is provided, including a square base having a path formed thereon made substantially of movable projections, each projection including a plurality of plateaus; a first, small figure resembling a human or animal which is manually movable about the path; a plurality of loose members resembling eggs or rocks capable of being temporarily received by the first, small figure; a second, larger figure resembling a dinosaur fixedly attached to the base and having a movable mouth; and an operating mechanism including a push button and being connected between the movable projections and the mouth of the second, large figure for moving the movable projections and the second figure's mouth, when the push button is pushed. When a first figure is located on a projection that is moving while supporting a loose member, the first figure and/or the loose member may be caused to fall off of the projection. Such a result causes a player to return the first figure to the start and to return the loose member to an area near the second figure. The object of the game then is to complete at least one lap around the path with a first figure while the first figure is receiving a loose member.

7 Claims, 5 Drawing Figures

GAME APPARATUS

BACKGROUND OF THE INVENTION

This invention relates to an amusement device and, more particularly, to a game having a three-dimensional playing surface with movable parts.

SUMMARY OF THE INVENTION

It is a primary object of the present invention to provide an amusement device for attracting and capturing the interest of a child and maintaining that interest for a reasonable period of time.

It is another object of this invention to provide an amusement device which is unpredictable and therefore entertaining for children of different age levels.

It is another object of this invention to provide an amusement device which may be operated by children of different age levels.

Additional objects and advantages of the invention will be set forth in part in the description which follows, and in part will be clear from the description, or may be learned by practice of the invention. The objects and advantages of the invention may be realized and obtained by means of the instrumentalities and combinations particularly pointed out in the appended claims.

To achieve the foregoing objects and in accordance with the purpose of the invention, as embodied and broadly described herein, the present invention is an amusement device, including: a substantially square base having a path formed thereon made substantially of movable projections, each projection including a plurality of plateaus; a first small figure resembling a human or animal which is manually movable about the path; a plurality of loose members resembling eggs or rocks capable of being temporarily received by the first figure; a second, large figure resembling a dinosaur fixedly attached to the base and having a movable mouth; and an operating mechanism including a push button and being connected between the movable projections and the mouth of the second figure for moving at least one of the movable projections and the second figures mouth when the push button is pushed. When a first figure is located on a projection that is moving while supporting a loose member, the first figure and/or the loose member may be caused to fall off the projection. Such a result causes a player to return the first figure to the start and to return the loose member to the area near the second figure. The object of the game is to complete at least one lap around the path with a first member while it is receiving a loose member.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the present invention illustrated in the accompanying drawings.

Figure 1:
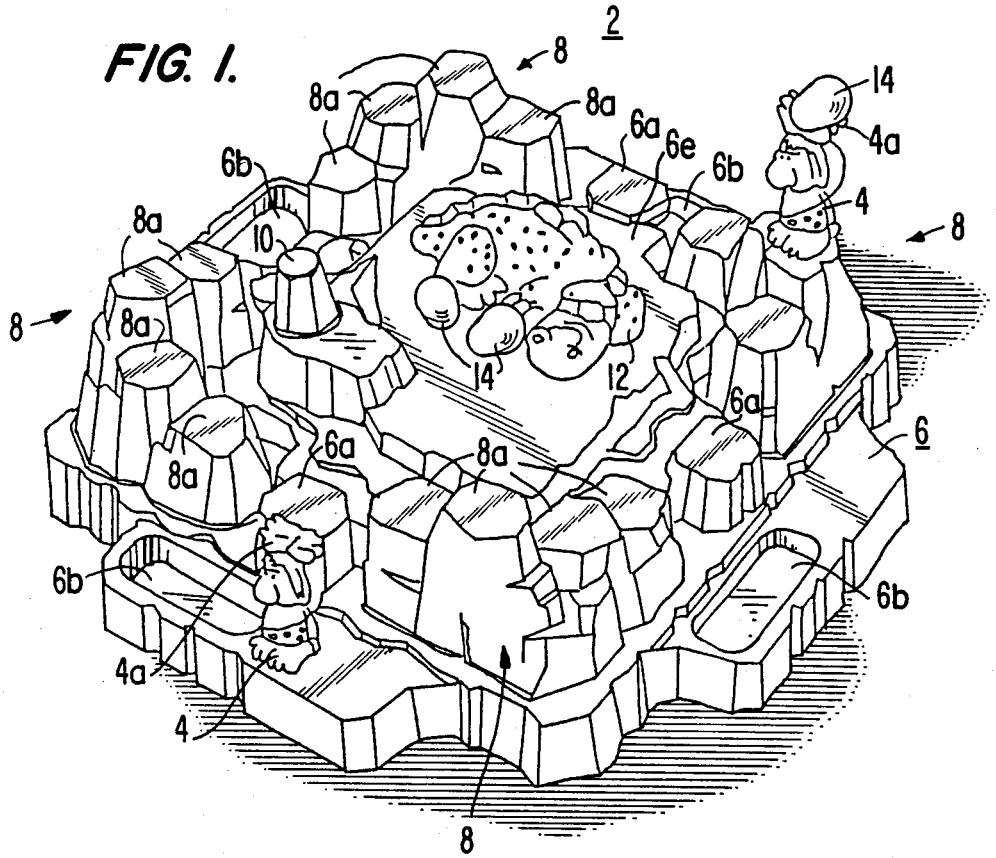
FIG. 1 is a perspective view of the amusement device of the present invention, illustrating particularly exemplary locations of the first, small figure; the loose members and the second, large figure relative to the base.
Figure 2:
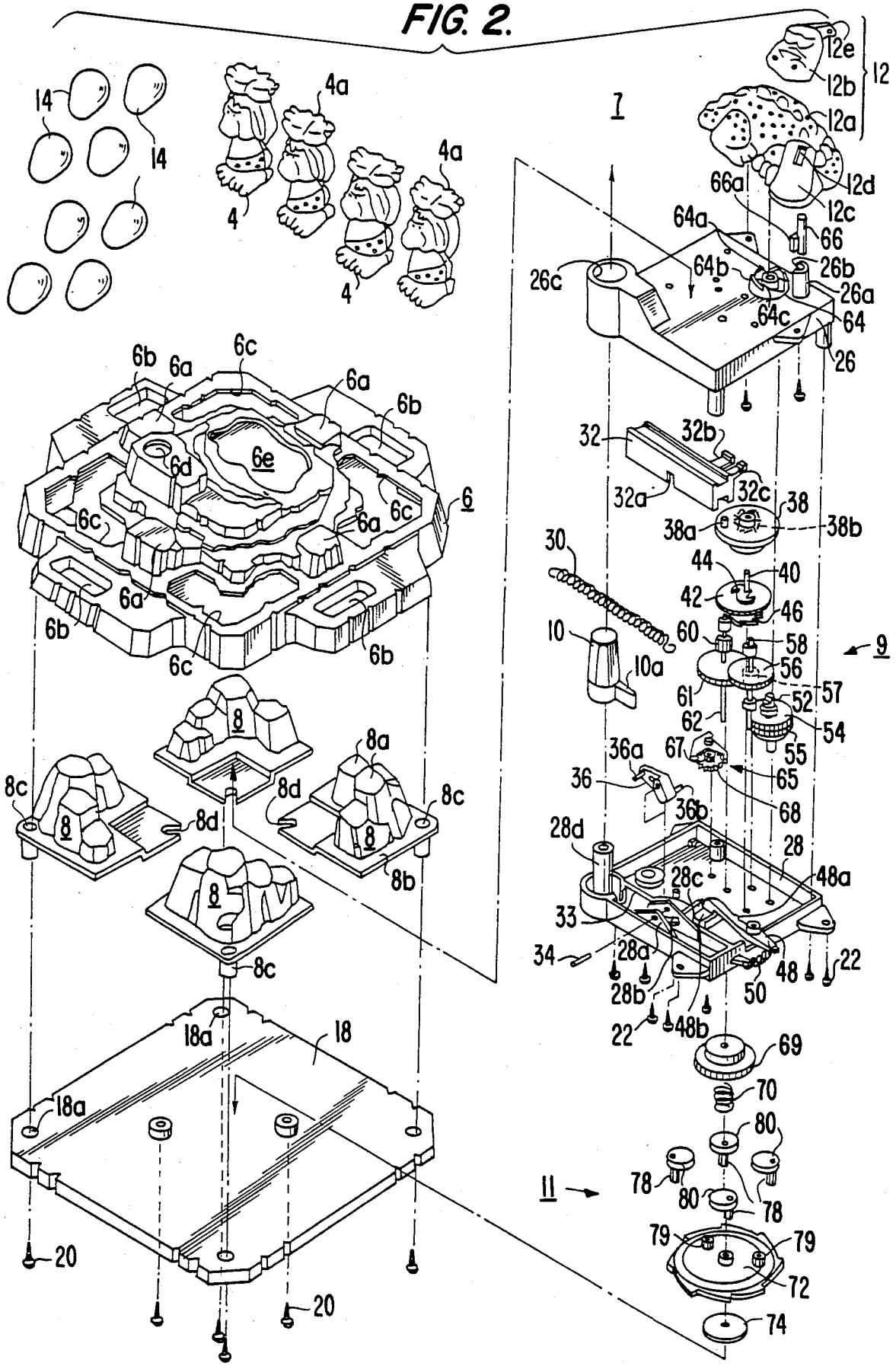
FIG. 2 is an exploded perspective view of the amusement device of the present invention, illustrating particularly the base and the operating mechanism therein.

As shown in FIGS. 1 and 2, the present invention is an amusement device indicated generally by reference numeral 2. This amusement device 2 includes generally: a plurality of first, small figures 4; a base 6; an operating mechanism 7 having a gear train 9 and related members, a push button 10 and a ratchet mechanism 11; a plurality of movable projections 8; a second, large figure 12; and a plurality of loose members 14.

More particularly, as shown in FIGS. 1 and 2, the base 6 includes a plurality of plateaus **6*a* and a plurality of troughs 6*b*. Located centrally of the base 6 in a recess 6*e* is the large figure 12 preferably resembling a dinosaur, aside of which may be placed several of the plurality of loose members 14. The large figure 12 includes a body 12*a* and an upper jaw 12*b*, which is hingedly mounted via an extension 12*e* to a lower jaw 12*c* through an opening 12*d***.

Placed through each opening **6*c* formed in the base 6 there is located one of the plurality of movable projections 8, each projection having a plurality of plateaus 8*a* formed thereon. Together, the plateaus 6*a* and 8*a* form a "path" on the base 6**.

Each of the movable projections 8 include, in addition to the plurality of plateaus **8*a*: a flat portion 8*b*, an opening 8*c* for receiving in pivotal relation a projection (not shown) formed at a corner of the underside of the base 6; and a receptacle 8*d* formed at a corner opposite the shaft 8*c*. Each receptacle 8*d* is intended to receive a cam 80 of the ratchet mechanism 11** to be discussed hereafter.

The plurality of small figures 4, which preferably resemble a human or an animal, may be positioned on the base 6. Each small figure 4 is capable of temporarily receiving one of the plurality of loose members 14 via a receptacle **4*a*. The loose members 14** preferably resemble eggs or rocks.

The base 6 also includes an opening **6*d* for receiving the push button 10 of the operating mechanism 7 to be discussed more fully hereafter. Finally, the base 6 includes a sub-base 18 which is connected to the base 6 via screws 20 inserted through openings 18*a* formed in the sub-base 18 and into the projections (not shown) formed on the underside of the base 6**.

The operating mechanism 7 is shown in detail in FIGS. 2–4(A) and (B). As stated above, this operating mechanism 7 includes the gear train 9, the ratchet mechanism 11 and the push button 10.

More particularly, the operating mechanism 7 includes an upper housing 26 and a lower housing 28 connected via screws 22. The upper housing 26 includes a hollow cylinder **26*a* having an opening 26*b* formed therein. The hollow cylinder 26*a* receives a shaft 66 having a projection 66*a* formed thereon which moves within opening 26*b*. The upper housing 26 also includes at an opposite end thereof an opening 26*c* formed therein for receiving the push button 10. A first toothed wheel 64 is positioned on the top of the upper housing 26. The first toothed wheel 64 includes a central opening 64***a* for receiving a shaft 52 and includes two large opposing teeth 64*b* and a plurality of smaller teeth 64*c*.

Located between the upper and lower housings 26 and 28, respectively, are the gear train 9 and related members. More particularly, a slide bar 32 is positioned on a partition 33 formed in the lower housing 28. The slide bar 32 includes a receptacle 32*a* formed in the bottom thereof, a first arm 32*b* and a second arm 32*c*. A space is formed between the arms 32*b* and 32*c* for receiving a projection 38*a* to be discussed hereafter. A spring 30 is connected between the slide bar 32 and the lower housing 28 (see FIG. 3).

A pivot member 38 is connected to the lower housing 28 via a shaft 40. The pivot member 38 includes on the underside thereof a plurality of teeth 38*b* for receiving flexible arms or ratchets 44 formed on a first gear 42 located below the pivot member 38 on shaft 40. The pivot member 38 also includes the above-discussed projection 38*a* which is received by the arms 32*b* and 32*c*.

Below the first gear 42 is located a second gear 46. Further, a third gear 54 and a fourth gear 55 are mounted coaxially on the shaft 52 introduced above. A fifth gear 56 and a sixth gear 57 are also mounted co-axially on a shaft 58. A seventh gear 60 and an eighth gear 61 are mounted co-axially on a shaft 62. A ratchet 65 is pivotally mounted on the lower housing 28 and is capable of making contact with a tenth gear 68 which is mounted co-axially with a ninth gear 67.

The lower housing 28 also includes: a lever support mechanism 28*a;* an opening 28*b* for receiving a projection 36*b* formed at one end of a lever 36; another opening 26*c* for receiving the leg 48*b* of arm 48; and a shaft 28*d* for receiving the push button 10 thereon. The push button 10 has a projection 10*a* formed at the bottom thereof. The lever 36, having a projection 36*a* formed at one end and the projection 36*b* formed at the other end, is received by the lever support mechanism 28*a* with the projection 36*b* moving within the opening 28*b*. The lever is pivotally mounted via a shaft 34.

The arm 48 is pivotally mounted on the lower housing 28. The arm 48 includes a tooth 48*a* formed along the midportion thereof. One end of the arm 48 is biased via a spring 50 also attached to the lower housing 28.

Figure 4A:
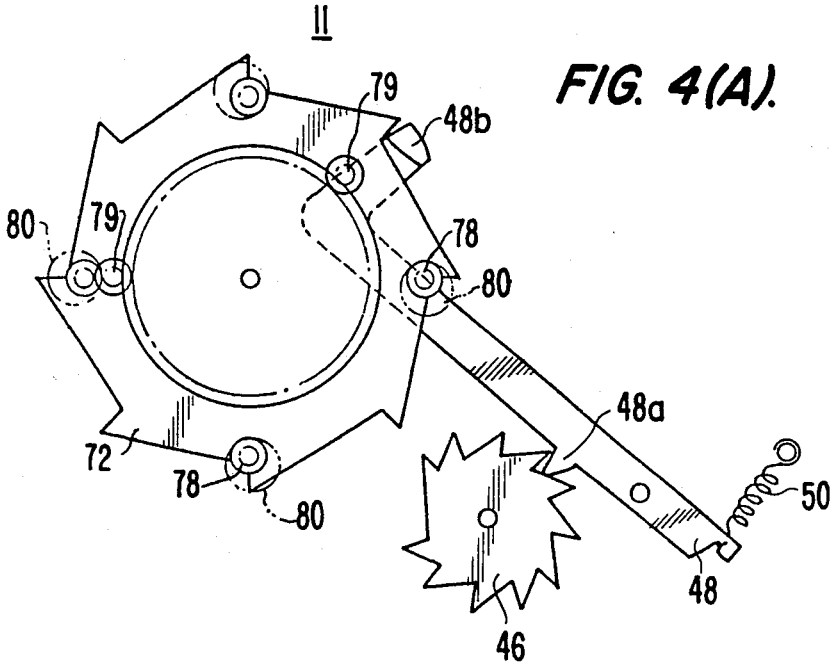
FIG. 4A is a top view of the ratchet mechanism of the amusement device of the present invention.
Figure 4B:
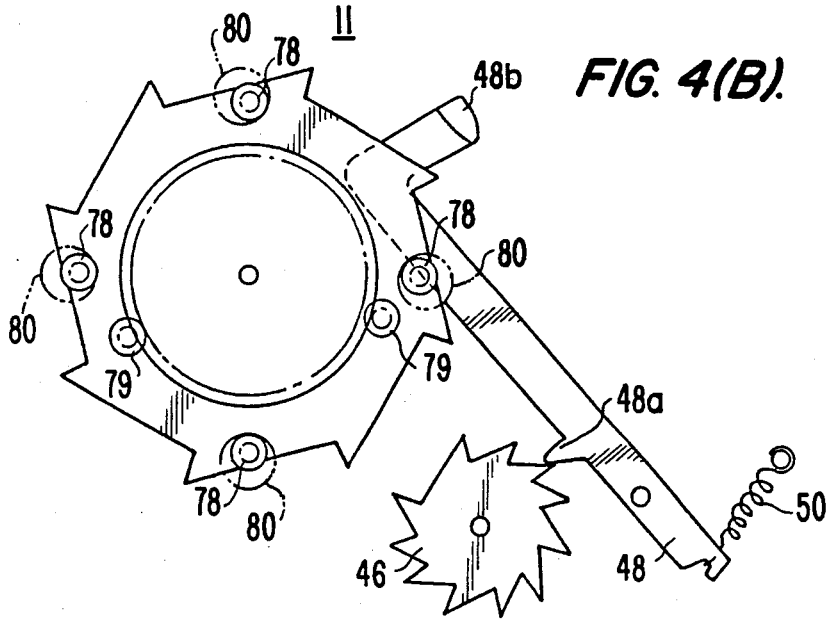
FIG. 4B is a top view of the ratchet mechanism of the amusement device of the present invention.

FIGS. 2, 4A and 4B best illustrate the ratchet mechanism 11 of the present invention. The ratchet mechanism 11 includes an eleventh gear 69 mounted coaxially of a toothed wheel 72 with a spring 70 therebetween. In addition, a plurality of cams 80 are attached for rotation to the bottom of the lower housing 28. Each cam 80 includes a twelfth gear 78 descending therefrom for rotational movement. Further, the toothed wheel 72 includes two thirteenth gears 79 formed on the top thereof to mesh with the eleventh gear 69. Finally a washer 74 is attached to the shaft 62 to terminate the ratchet mechanism 11.

Figure 3:
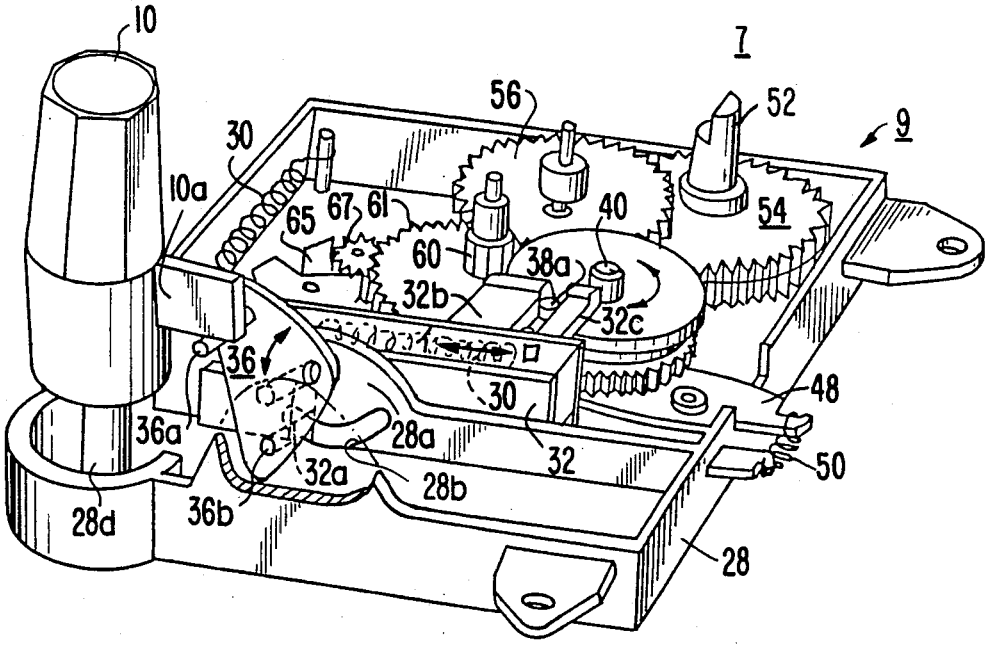
FIG. 3 is a perspective view of the operating mechanism of the amusement device of the present invention.

FIGS. 2–4 best illustrate the cooperative arrangement and operation of the members of the operating mechanism 7. First, the opening and closing of the mouth of the large figure 12 will be described.

As can be seen, the slide bar 32 is normally biased via spring 30 in the direction of the push button 10. By pressing the push button 10 downward the projection 10*a* formed thereon forces the projection 36*a* formed on the lever 36 to move counterclockwise. This action causes the projection 36*b* to move counterclockwise within the opening 28*b* and moves the slide arm 32 against its naturally biased condition. By so doing, the projection 38*a* is moved away from the push button 10 since it is held between moving arms 32*b* and 32*c*. This action also rotates the pivot member 38 counterclockwise. Upon release of the push button 10, the pivot member 38 moves clockwise and rotates the first gear 42 slowly therewith via teeth 38*b* and flexible arms 44 until the kinetic energy of the spring 30 is expended. As a result, the fourth gear 55 meshed therewith rotates with the first gear 42, as does the third gear 54 coaxial therewith. When the third gear 54 rotates, the shaft 52 is turned, thus causing the first toothed wheel 64 to turn. This action causes the teeth 64*b* and 64*c* of the first toothed wheel 64 to move the shaft 66 upwardly and downwardly. In the upward movement, the shaft 66 abuts the extension 12*e* of the upper jaw 12*b* and causes the upper jaw 12*b* to move upwardly relative to the lower jaw 12*c* of the large figure 12. As a result, the large figure 12 appears to open and close its mouth, as if being awakened or startled.

Now the movement of the projections 8 will be described. When this first gear 42 rotates clockwise, as described above, the second gear 46 also rotates therewith and its teeth receive the tooth 48*a* of the arm 48. As a result, the arm 48 is slowly moved along one or two teeth of the second gear 46, before the kinetic energy of the spring 30 is expended. This is made possible by the fact that the arm 48 is pivoted and spring biased against gear 46 via spring 50. When the tooth 48*a* is between two teeth of the second gear 46, as shown in FIG. 4A, the leg 48*b* contacts the teeth of the toothed wheel 72 and the toothed wheel 72 is prevented from rotating. In addition, at least one of the rotating thirteenth gears 79 meshes with and rotates one of the twelfth gears 78. On the other hand, as shown in FIG. 4B, when the tooth 48*a* of the arm 48 abuts the point of a tooth of the second gear 46, the arm 48 is pivoted away from the second gear 46 and the leg 48*b* no longer abuts a tooth of the toothed wheel 72, thus allowing the toothed wheel 72 to turn to the next tooth thereof.

Further, as gears 54 and 55 rotate, they cause sixth gear 57 and fifth gear 56 located on shaft 58 to rotate. This action causes seventh gear 60 and eighth gear 61 to rotate. As mentioned above, eighth gear 61 meshes with ninth gear 67 and tenth gear 68 which are operatively connected with the ratchet 65. As noted above, eighth gear 61 is attached to shaft 62, which the ratchet mechanism 11 is also attached to. More particularly, as the eighth gear 61 and shaft 62 rotate, the eleventh gear 69 and toothed wheel 72 attached to the shaft 62 also rotate unless stopped by the arm 48, as described above. When oriented as shown in FIG. 4A, one of the thirteenth gears 79 located on the toothed wheel 72 temporarily meshes with one of the twelfth gears 78 located on a cam 80. When a twelfth gear 78 rotates, the corresponding cam 80, which is received by a corresponding receptacle 8*d* of a projection 8, causes this projection 8 to vibrate within the opening 6*c* in the base 6.

As stated above, the arm moves across about two teeth on second gear 46 for each depression of the push button 10. Accordingly, up to two projections 8 will be moved during each depression of the push button 10. Finally, since the toothed wheel 72 is rotating, the projections 8 are moved in succession, although appearing somewhat erratic, because either one or two neighboring projections 8 will be moved during each depression of the push button 10.

The above-discussed movement of the operating mechanism 7 extends for a short period of time until the kinetic energy in spring 30 is expended and the slide bar 32 returns to its original position ready to be pushed again.

The preferred manner of play of the amusement device 2 of the present invention will now be described.

This amusement device 2 may be played by two to four players. Each player is provided with a color coded small figure 4. The preferred number of loose members 14 is twelve and these are placed beside the large figure 12. Each player moves in clockwise order, and the first player puts his small figure 4 at the side of trough 6*b* nearest him as shown in FIG. 1. The first player then throws a die and the small figure 4 is advanced along the plateaus 8*a* and 6*a* of the path 8 corresponding to the number indicated on the die. Each of the projections 8*a* and 6*a* may include a different indicia thereon. For example, a plateau may include an indicia signifying that a loose member 14 should be picked up or that the push button 10 must be pushed. More particularly, if the small figure 4 lands on a projection 8*a* with indicia that the player can pick up one loose member 14 from near the large figure 12, the player puts the loose member in the receptacle 4*a* of the small figure 4 for temporary support. If the small figure 4 already is supporting a loose member 14, the instruction is disregarded. If, on the other hand, the small figure 4 lands on a plateau having an indicia that the push button 10 must be pushed, the player must then push the push button 10. When the push button 10 is pushed and released, as described above, the large figure 12 opens its mouth 12*e*, i.e., yawns, and the projections 8 are caused to move or "quake." Once the push button 10 has been pushed, the players are not allowed to touch any small figure 4 or the loose member 14. If, due to the quake, the small figure 4 and the loose member 14 fall down, the loose member 14 must be replaced to its original position near the large figure 12 and the small figure must return to its original position. On the other hand, if only the loose member 14 falls, it is returned but the small member 4 may stay at the same position.

If, in playing the game a small figure 4 is moved and lands on the same plateau as another small figure 4, the small figure being moved can advance to the next available plateau and can take the loose member 14 from the small figure passed by, if applicable. Even if a small figure is passed by as described immediately above, once the small figures 4 lands on a space, the indicia must be followed as described below. If a series of small figures 4 are resting on consecutive plateaus, the small figure 4 being moved is merely moved to the first available plateau.

If the small figure 4 being passed is not supporting a loose member 14, but the small figure 4 being moved is temporarily supporting a loose member, the small figure 4 being moved gives up its loose member 14 to the small figure 4 being passed. Again, when the small figure 4 being moved lands on a plateau, the indicia thereof must be followed.

If both the small figure 4 being moved and the small figure 4 being passed are each temporarily supporting a loose member 14, the player moving his small figure 4 can take the loose member 14 off the small figure 4 being passed and place it in his own trough 6*b*. The small figure 4 being moved gets to keep its own loose member 14.

The goal of the game is to make one lap around the path of plateaus 6*a* and 8*a* while supporting the loose member 14. Once a player gets around the path of plateaus 8*a* and 6*a*, the player can put the loose member into the trough 6*b*. The player who succeeds in getting the most loose members 14 into his trough 6*b* is the winner. Of course, various goals may be set, for example, the first who gets three loose members 14 into the trough is the winner.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to falling within the scope of the invention and the appended claims and their equivalents.

I claim:

1. An amusement device, comprising:

(a) a base having a path formed thereon;

(b) a plurality of movable means attached to the base and forming a part of the path;

(c) a single operating means connected to the plurality of movable means for randomly moving one of the plurality of the movable means;

(d) actuating means connected to the operating means, (e) at least one first figure movable about the path; and (f) at least one loose member capable of being temporarily received by the first figure, wherein, when the actuating means is actuated, the operating means moves the maovable means with the potential for displacing at least one of the first figure from the movable means and the at least one loose member from the first figure.

2. The amusement device as recited in claim 1, wherein the movable means comprises:

a plurality of projections, each having a plurality of substantially planar plateaus formed thereon, and wherein the first figure includes a substantially planar base for being supported by each of the plurality of plateaus.

3. An amusement device comprising:

(a) a base having a path formed thereon;

(b) movable means attached to the base and forming a part of the path, wherein the movable means includes a plurality of projections, each having a plurality of plateaus formed thereon;

(c) operating means connected to the movable means for moving the movable means, wherein the operating means includes actuating means movably connected to the base;

(d) at least one first figure movable about the path;

(e) at least one loose member capable of being temporarily received by the first figure;

(f) a second figure fixed to the base having a movable element operatively connected to the operating means, wherein, when the actuating means is actuated, the operating means moves the at least one of the plurality of movable projections and the movable element of the second figure.

wherein when the operating means operates, at least one of the plurality of movable projections moves.

4. The amusement device as recited in claim 2, wherein, when the at least one first figure and the at least one loose member are located on one of the plurality of movable projections and one of the at least one movable projections moves, the at least one loose member is no longer received by the at least one first figure.

5. The amusement device as recited in claim 4, wherein the operating means further comprises:

a gear train connected to a kinetic energy source.

6. The amusement device as recited in claim 5, wherein the at least one first figure is a plurality of first figures and the at least one loose member is a plurality of loose members.

7. An amusement device, comprising:

(a) a base having a path formed thereon;

(b) a plurality of projections movably attached to the base and forming a part of the path;

(c) an operating mechanism connected to the plurality of movable projections, including:

(i) an actuating member movably connected to the base, (ii) a gear train operatively connected between the actuating member and the plurality of movable projections, (iii)a kinetic energy source connected to the gear train;

(d) a plurality of first figures manually movable about the path;

(e) a plurality of loose elements, each being capable of temporary reception by one of the plurality of first figures; and (f) a second figure fixed to the base, said second figure having a movable element operatively connected to the operating mechanism, wherein, when at least one of the first figures is located on one of the plurality of movable projections while receiving a loose element and the operating mechanism is actuated via the actuating member, at least one of the plurality of movable projections and the movable element move and said loose element is no longer received by said corresponding first figure.

* * * * *

UNITED STATES PATENT AND TRADEMARK OFFICE

CERTIFICATE OF CORRECTION

PATENT NO. : 4,696,477

DATED : September 29, 1987

INVENTOR(S) : Akio Tsuzuki

It is certified that error appears in the above-identified patent and that said Letters Patent is hereby corrected as shown below:

Column 1, line 43, "figures" should read --figure's--.

Column 6, line 65 "claim 2" should --claim 3 --.

Signed and Sealed this

Twelfth Day of April, 1988

*Attest:*

DONALD J. QUIGG

*Attesting Officer*

*Commissioner of Patents and Trademarks*